United States Patent [19]

Schmaling

[11] Patent Number: 5,006,194

[45] Date of Patent: Apr. 9, 1991

[54] APPARATUS FOR MOISTENING ENVELOPE FLAP

[75] Inventor: Roderick N. Schmaling, Brookfield Center, Conn.

[73] Assignee: Pitney Bowes Inc., Stamford, Conn.

[21] Appl. No.: 281,607

[22] Filed: Dec. 9, 1988

[51] Int. Cl.[5] ..... B05G 1/02

[52] U.S. Cl. ..... 156/442.1; 156/442.2; 118/257; 118/259; 118/266

[58] Field of Search ..... 156/441.5, 442.1, 442.2; 118/243, 257, 259, 263, 266

[56] References Cited

U.S. PATENT DOCUMENTS

| | | | |
|---|---|---|---|
| 1,985,293 | 12/1934 | Kimball | 156/453 |
| 2,253,060 | 8/1941 | Clearman | 118/401 |
| 3,884,745 | 5/1975 | Sette | 156/441.5 |
| 3,981,270 | 9/1976 | Bogdanski | 156/442.2 X |
| 4,038,941 | 8/1977 | Swaniger | 156/442.2 X |
| 4,450,037 | 5/1984 | Gavronsky | 156/441.5 |

*Primary Examiner*—Michael W. Ball
*Assistant Examiner*—Mark A. Osele
*Attorney, Agent, or Firm*—Charles R. Malandra, Jr.; David E. Pitchenik; Melvin J. Scolnick

[57] ABSTRACT

Apparatus for moistening the flap of an envelope. The apparatus includes: a tank for holding a volume of water; a moistening brush pivotably mounted on the tank, the tank having a vertical wall located beneath the brush; a first roller rotatably journalled in the tank; a second roller rotatably journalled in the tank and situated below the first roller; and an endless belt trained over the first and second rollers. The belt includes one reach situated adjacent but spaced from the vertical wall by an amount which permits a meniscus to be formed between the reach and the wall, whereby water is conveyed from the tank to the brush.

5 Claims, 7 Drawing Sheets

Fig. 8.
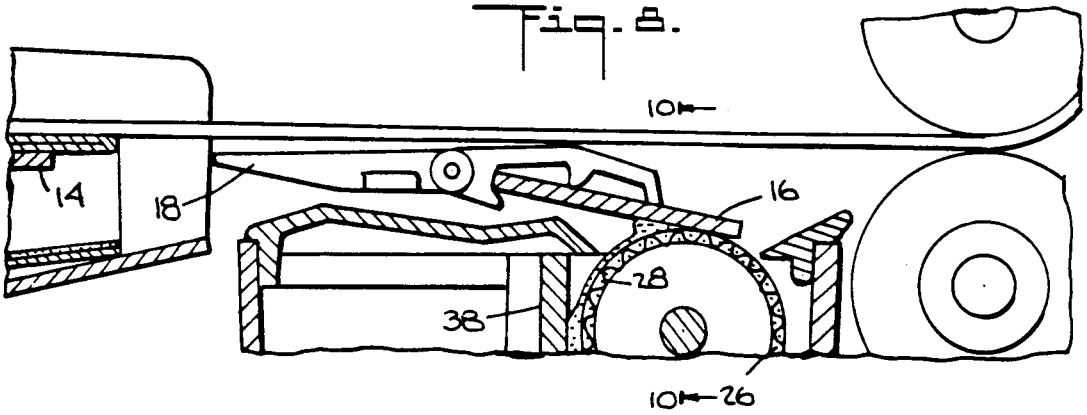
Fig. 9.
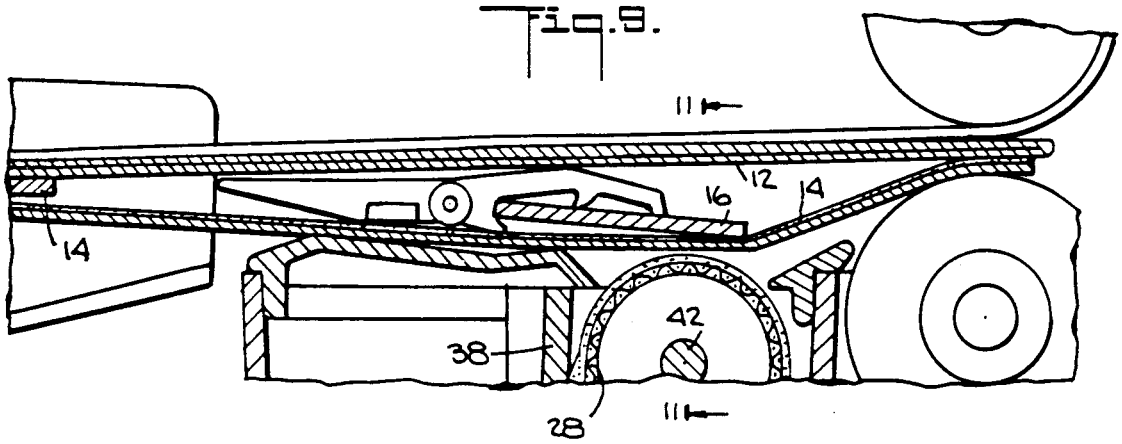
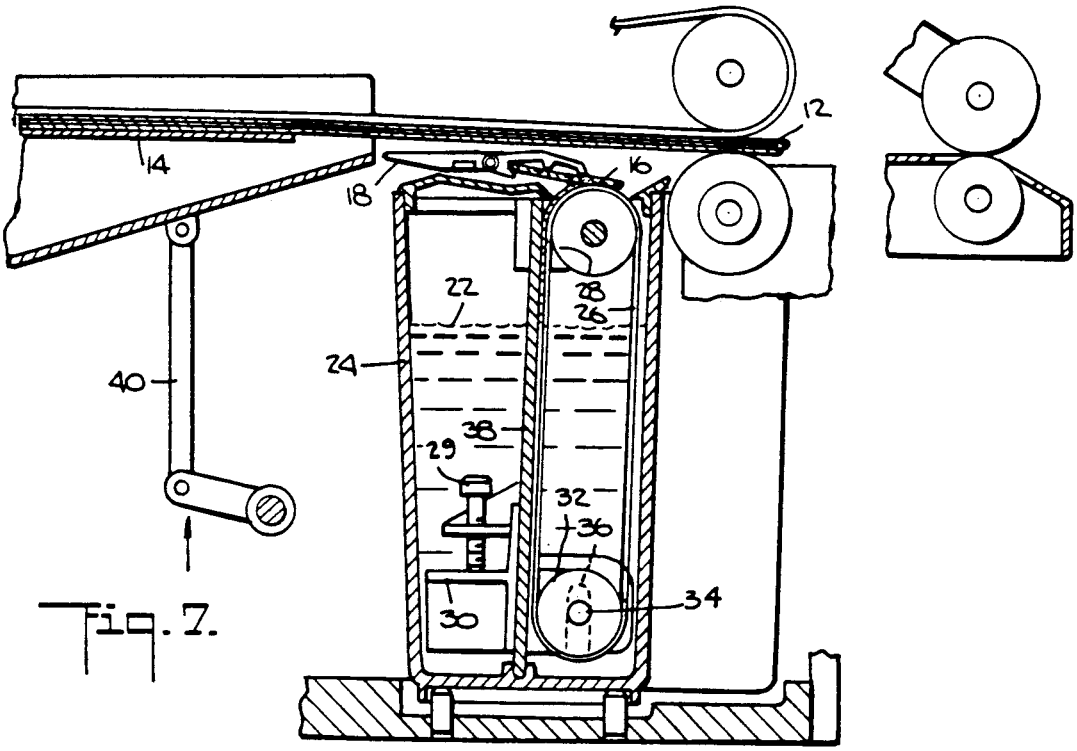
Fig. 7.

APPARATUS FOR MOISTENING ENVELOPE FLAP

The instant invention relates to apparatus for moistening the flap of an envelope, and more particularly, to apparatus for delivering water to the brush used to moisten the envelope flap.

In mail handling machines, moistening devices are used to wet the flap of an envelope in preparation for sealing the envelope. Conventionally, this wetting is done by feeding the envelopes past a stripper blade having a moistening brush attached thereto, which allows the wet brush to come into contact with the glue on the envelope flap. The water causes the glue to soften and become tacky to the touch. The envelopes are then fed between two sealing rollers which press the flap against the envelope body to form the seal. The envelope is then either ejected into a stacker or passed on to another part of the mail handling machine for further processing.

In commercial moisteners for wetting envelope flaps, a wick is used to draw water from a tank and transfer it to the moistening brush which rests against the wick. There are several drawbacks associated with the use of a wick, including the following:

1. An insufficient amount of water is delivered to the brush, which could be caused by (a) the water level dropping during use of the moistening brush and the wick being unable to draw the water fast enough, or (b) a steady run of long envelopes which reduces the time the brush is in contact with the wick, resulting in insufficient water being transferred to the brush.

2. The transfer of water is in one direction, which is up into the brush, which allows glue which has been transferred from previously processed envelope flaps to the brush to build up on the brush. This build-up glue will subsequently be transferred to non-glued portions of later-processed flaps, causing the flaps to stick to the inserts in the envelopes.

3. Because short wicks are used, the tank must be shallow so that the short wick can reach the bottom of the tank. A shallow tank is not desirable because in order to generate a sufficient volume of water for the brush, a large, shallow reservoir is required, from which water can easily spill over the sides if moved.

The foregoing problems are overcome by the instant invention which incorporates a belt to deliver water from a tank to the moistening brush.

SUMMARY OF THE INVENTION

The instant invention provides apparatus for moistening the flap of an envelope. The apparatus includes: a tank for holding a volume of water; a moistening brush pivotably mounted on the tank, the tank having a vertical wall located beneath the brush; an envelope feeding means, the feeding means adapted to transport an envelope whereby the flap of the envelope makes contact with said moistening brush; a first roller rotatably journalled in the tank; a second roller first roller; and an endless belt trained over the first and second rollers. The belt includes one reach situated adjacent but spaced from the vertical wall by an amount which permits a meniscus to be formed between the reach and the wall, whereby water is conveyed from the tank to the brush. The envelope further includes an envelope flap sealing means.

BRIEF DESCRIPTION OF THE DRAWINGS

FIG. 7 is similar to FIG. 6 except that the brush is in the non-wetting position and the envelope is moving over the brush;

FIG. 8 is an enlarged, central vertical sectional view showing the moistening brush in the wetting position without engaging an envelope so that the brush is wetted by the rotating belt;

FIG. 9 is the same as FIG. 2 except that an envelope is seen engaging the moistening brush;

DETAILED DESCRIPTION

Figure 1:
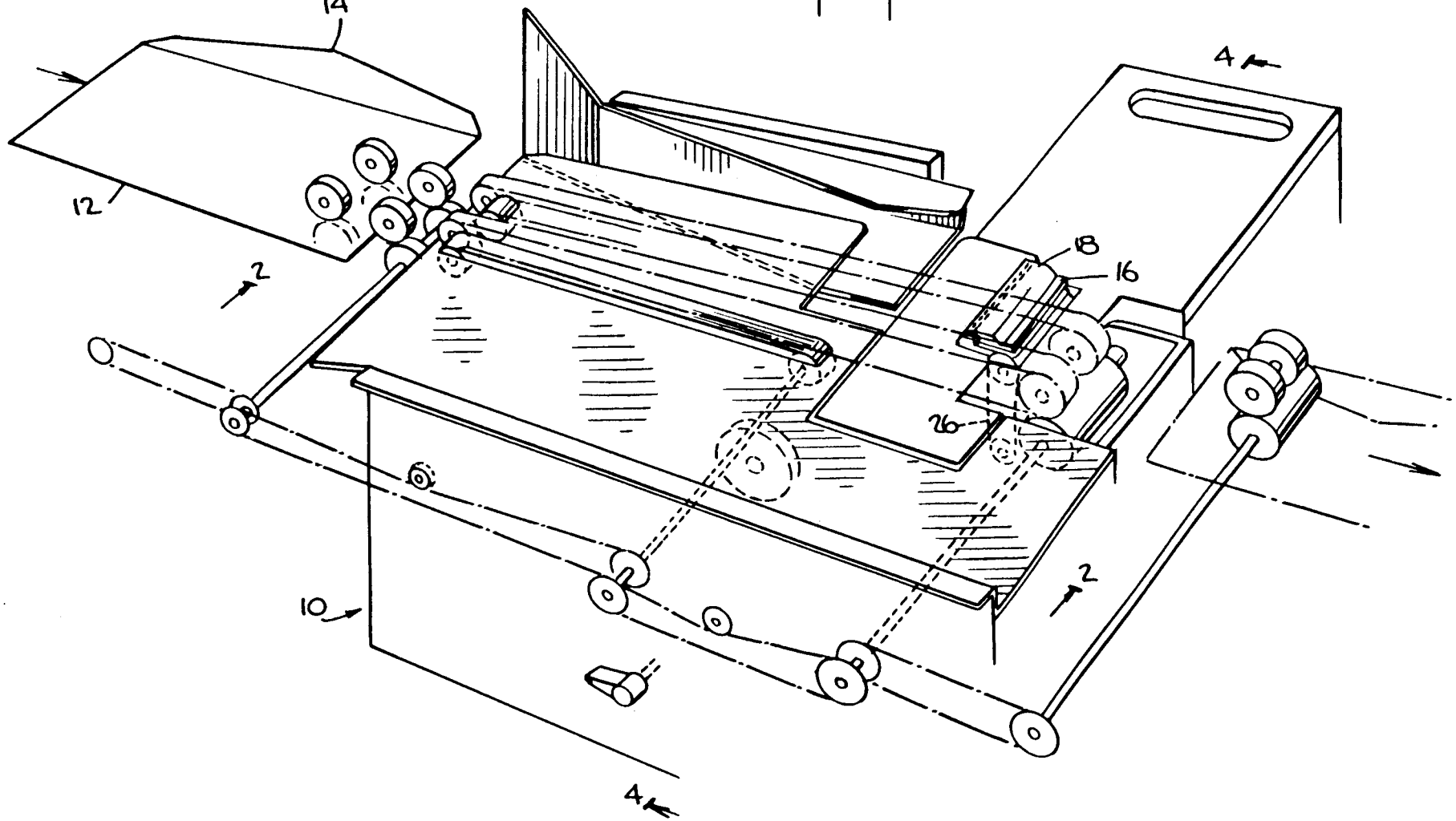
FIG. 1 is a perspective view of an envelope sealing apparatus in accordance with the instant invention with the top cover removed.
Figure 2:
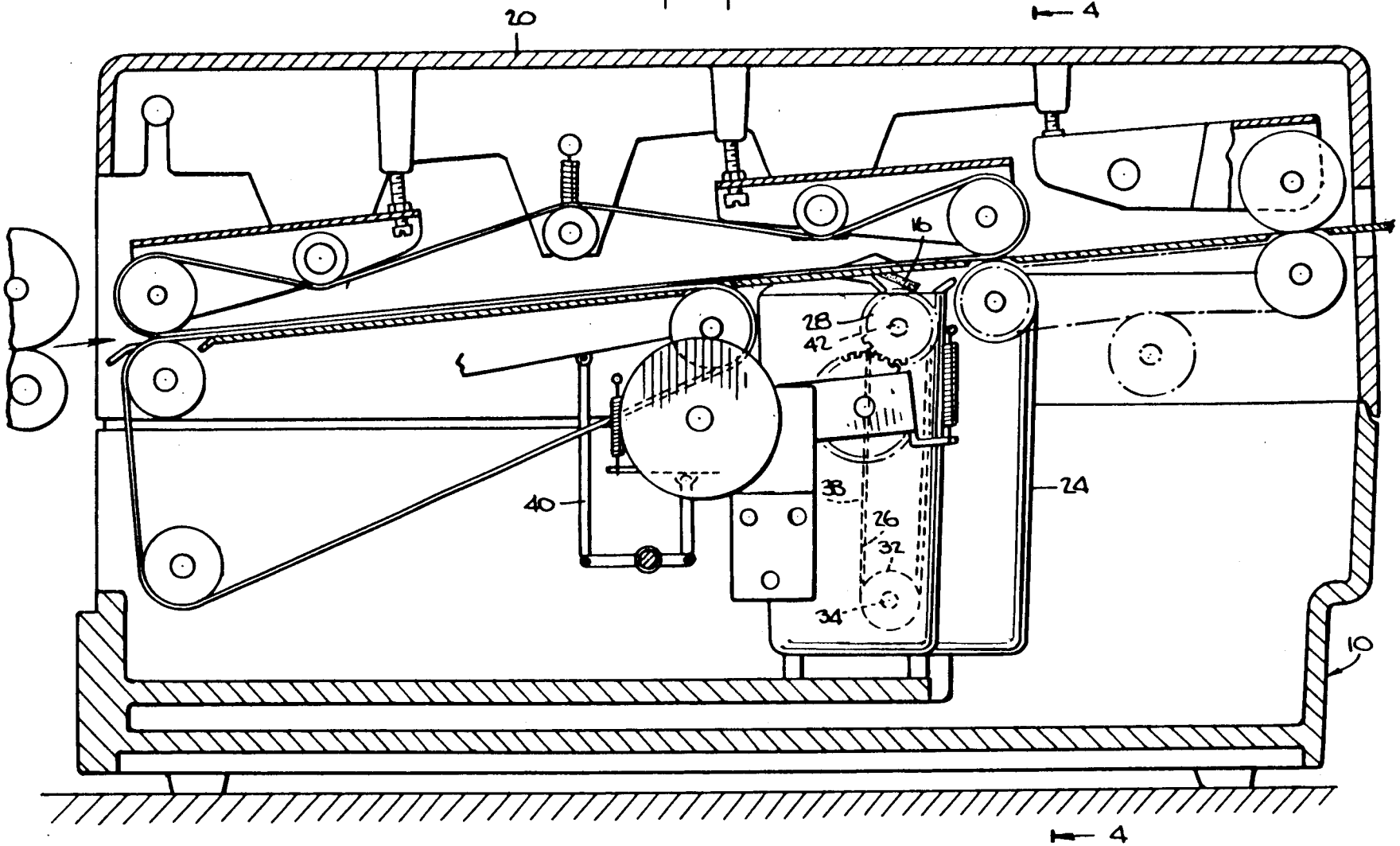
FIG. 2 is a sectional view taken on the plane indicated by the line 2—2 in FIG. 1 but with the top cover in its lowered, operative position.
Figure 3:
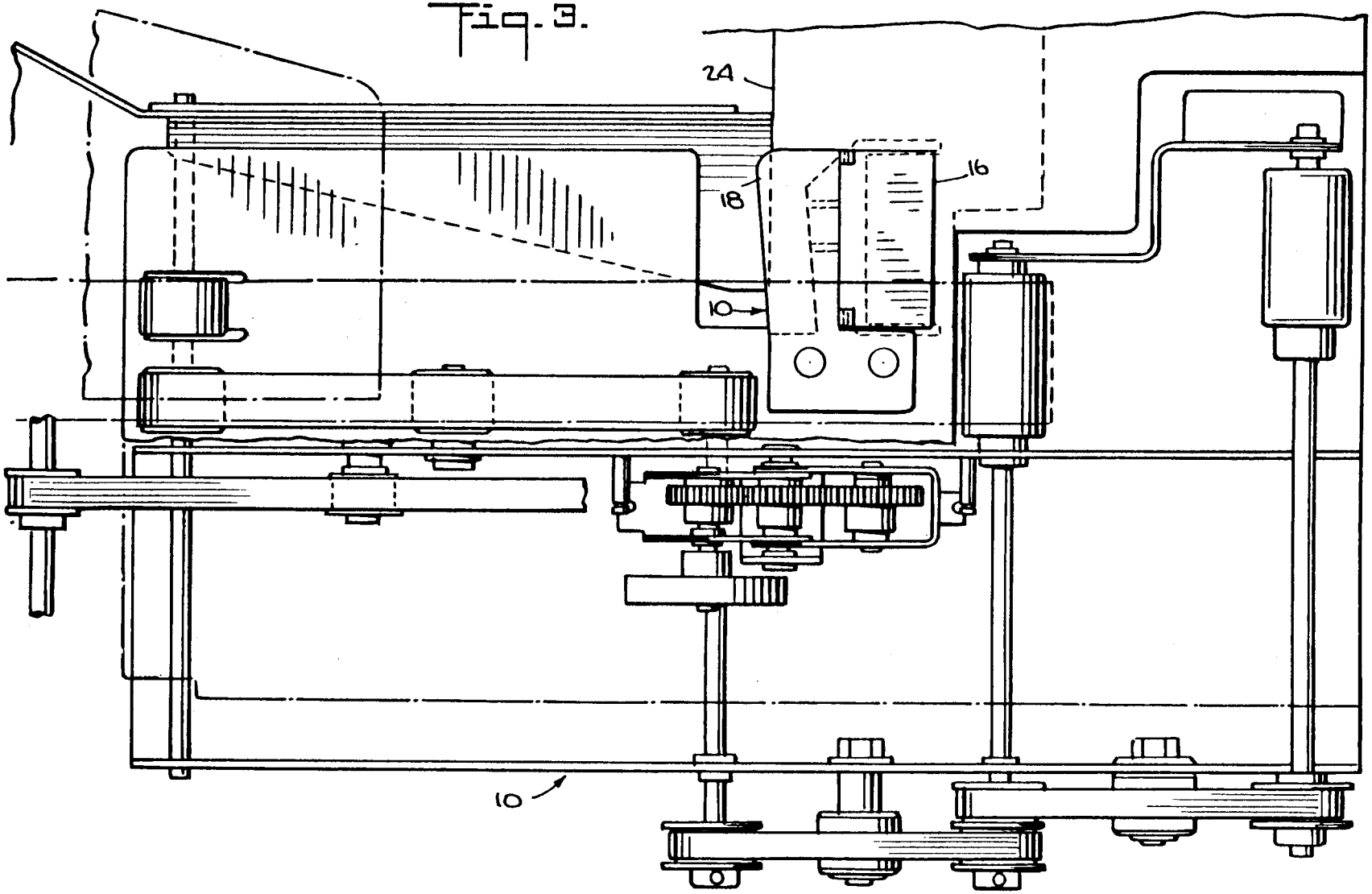
FIG. 3 is a top, plan view of the sealing apparatus seen in FIG. 1.
Figure 4:
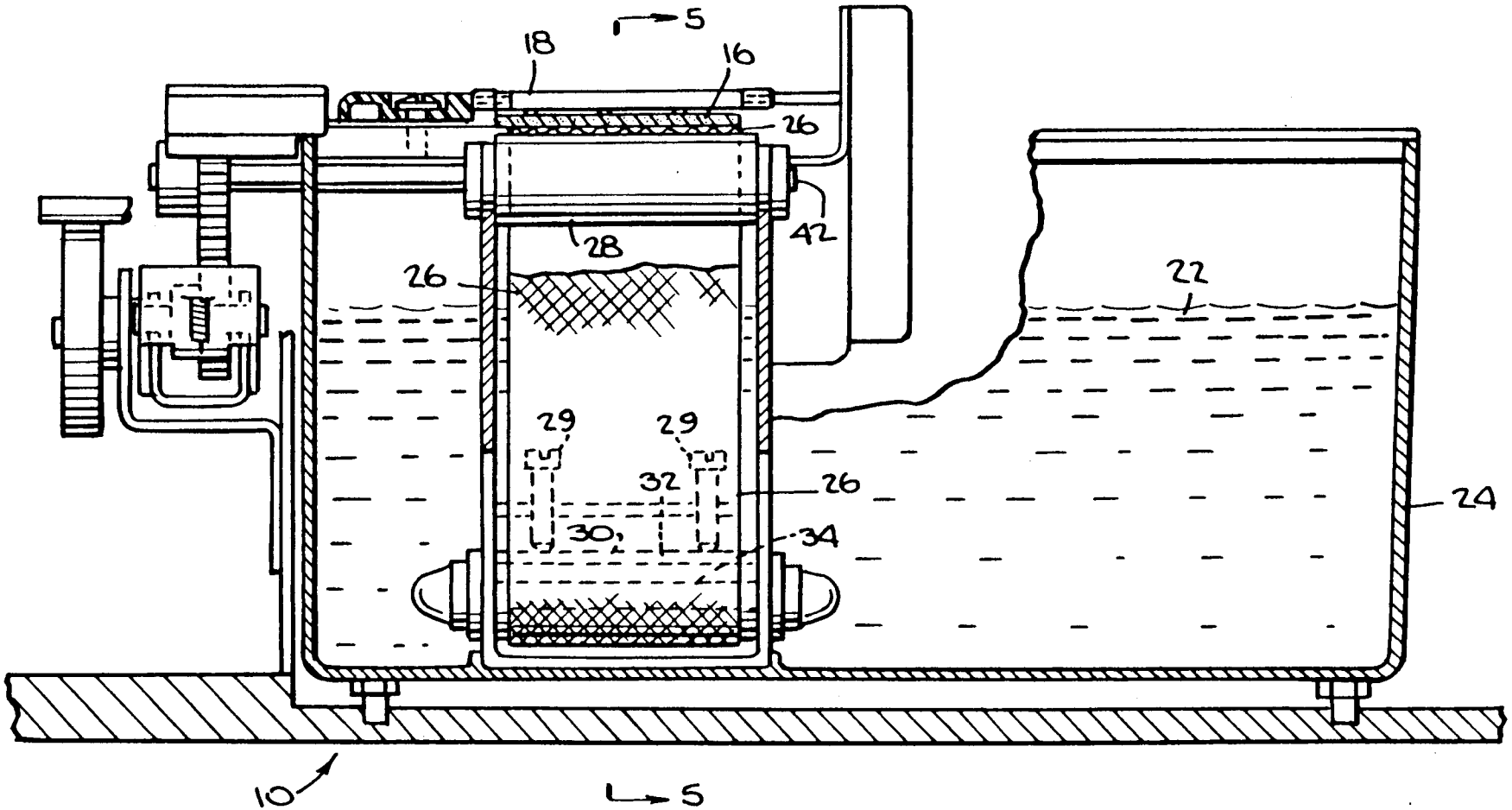
FIG. 4 is a sectional view taken on the plane indicated by the line 4—4 in FIG. 1.

In describing the preferred embodiment of the instant invention, reference is made to the drawings, wherein there is seen an envelope moistening module generally designated 10 for applying moisture to an envelope 12 having a flap 14 with glue on the inner surface thereof. The moisture is applied to the inner surface of the flap 14 by means of a brush 16 secured to the underside of a stripper blade 18 in conventional manner. The moistening module 0 shown herein is typically situated downstream of an envelope turner (not shown) and connected thereto. The module 10 includes a top cover 20 (see FIG. 2) carrying appropriate and conventional drive means (including belts and pulleys seen in the various figures) for operating the module 10.

A supply of water 22 is stored in a removable reservoir or tank 24 situated beneath the stripper blade 18 and brush 16. A belt 26 is used to deliver water 22 from the reservoir 24 to the brush 16. The belt 26 is driven by a drive roller 28 which drives the belt in a clockwise direction. The drive roller 28 is rotatably mounted on a shaft 42 which is journalled in the roller support 38 which is a substantially vertical wall forming a part of the tank 24. The quantity of water 22 delivered to the brush 16 can be varied by changing the speed of the drive roller 28. Tension on the belt 26 can be increased by tightening the adjusting screws 29 against the adjusting bracket 30 which is slidably mounted on the roller support 38. The take-up roller 32 is mounted on a shaft 34 which is slidably mounted in a pair of slots 36 of the roller support 38. The shaft 34 is also journalled in the adjustment bracket 30. Thus, by rotating the screws 29, the bracket 30 can be lowered which in turn lowers the shaft 34 in the slots 36. In the embodiment seen, the belt 26 and its associated drive can be removed from the reservoir 24 by lifting up the roller support structure 38.

Figure 5:
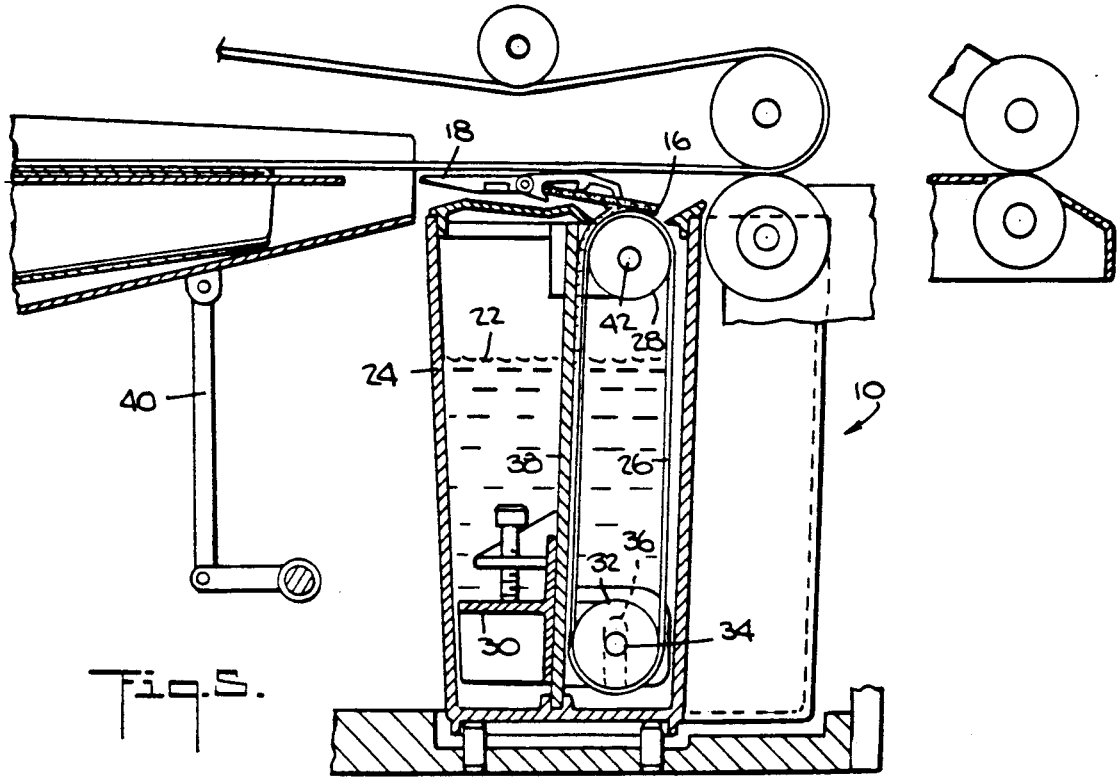
FIG. 5 is a sectional view taken on the plane indicated by the line 5—5 in FIG. 4 showing the moistening brush in the wetting position about to seal an approaching envelope.
Figure 6:
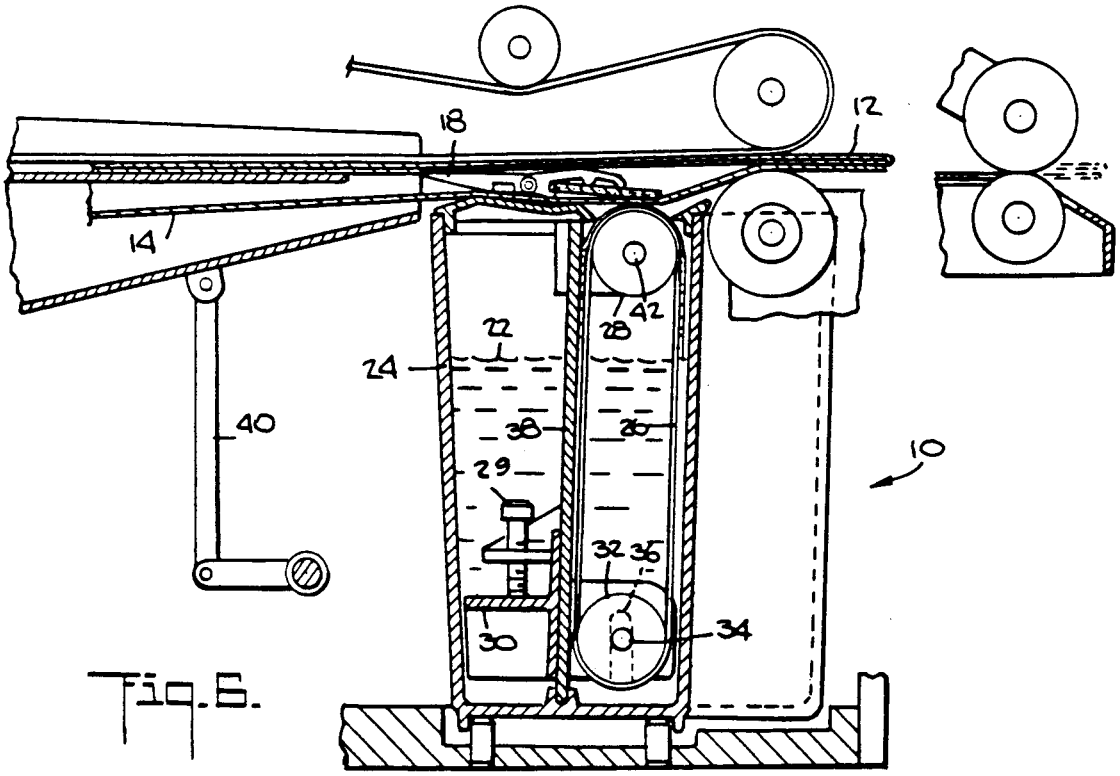
FIG. 6 is the same as FIG. 5 except that the envelope is seen moving past and engaging the moistening brush.
Figure 10:
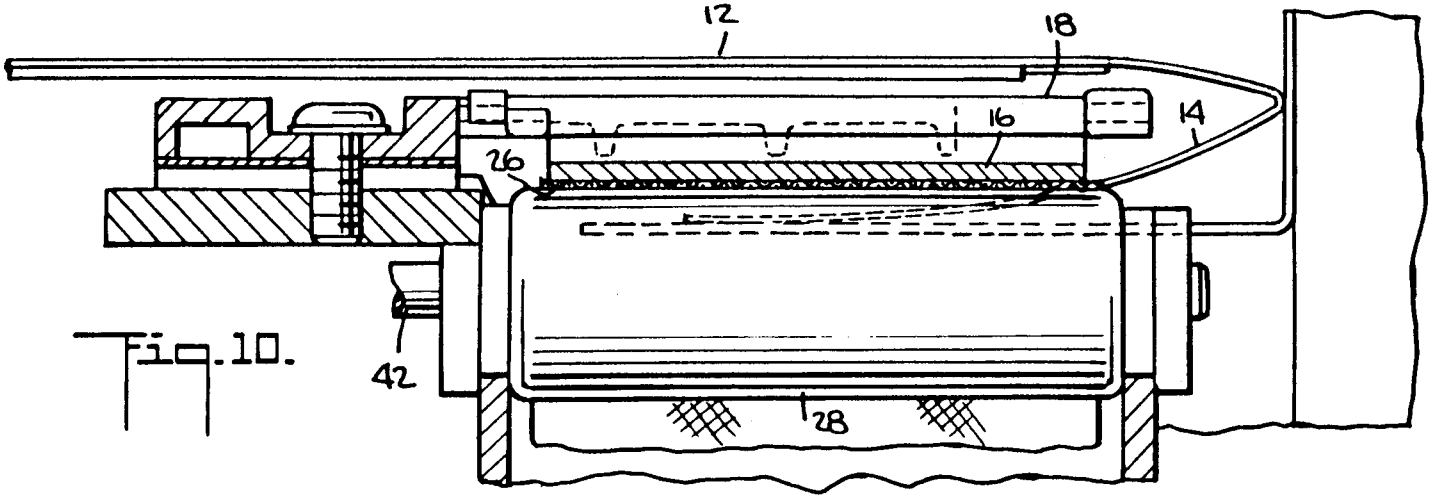
FIG. 10 is a sectional view taken on the plane indicated by the line 10—10 in FIG. 8.
Figure 11:
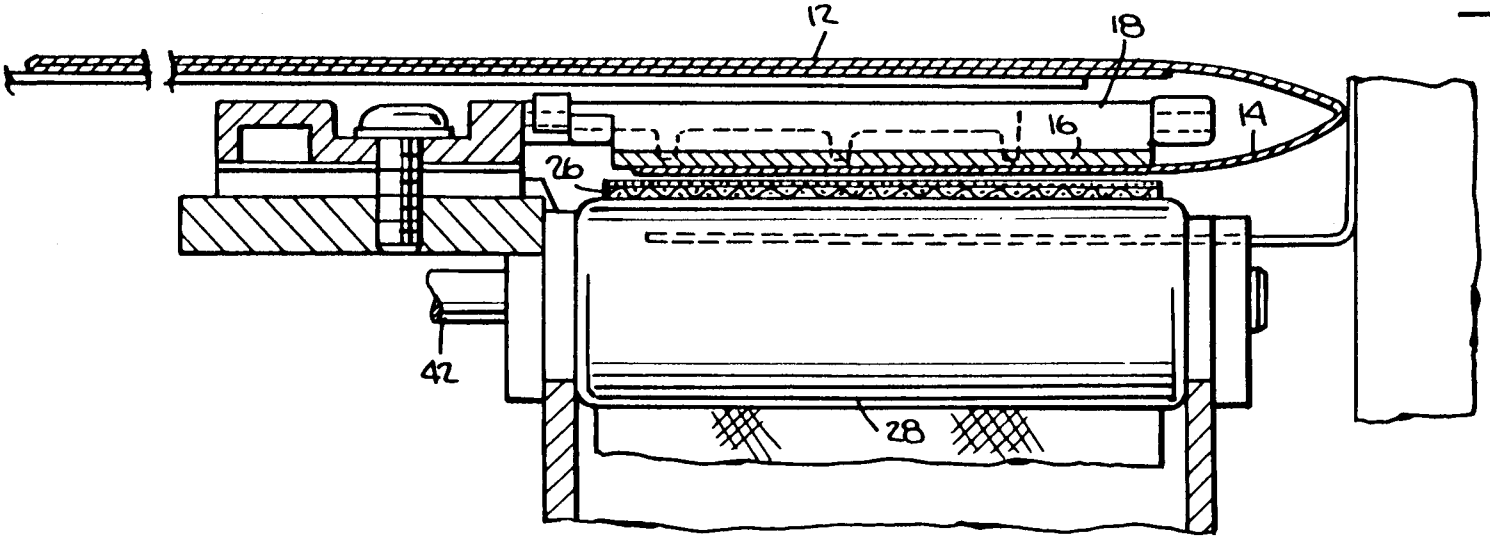
FIG. 11 is a sectional view taken on the plane indicated by the line 11—11 in FIG. 9.

As best seen in FIGS. 5–7, one reach of the belt 26 is almost contiguous but spaced from the roller support 38. By maintaining the proper distance between the belt 26 and the vertical wall of the roller support 38, a meniscus is formed between the belt 26 and the roller support 38. This phenomenon is caused by the surface tension of the water. As a result, water is carried by the clockwise rotating belt 26 from the reservoir 24 up to the underside of the brush 16.

It can be understood that by the use of the belt 26 the effects of a changing water level in the reservoir 24 are overcome. It can also be understood that the build-up of glue on the brush 16 is obviated, because once the brush 16 is saturated with water, any additional water brought up by the belt 26 will tend to wash the brush 16 clean of glue; the glue is transferred from the brush 16 to the reservoir 24, where it remains in solution until the reservoir 24 is cleaned or the water is used up.

As with conventional sealing modules, when it is desired to run the envelopes 12 by the sealing module 10 without moistening the flaps 14, the stripper blade 18 is lowered (see FIG. 7) so that the envelope 12 will pass over the blade 18 without the flap 14 being engaged and separated from the body of the envelope 12 preparatory to moistening. A mechanical linkage 40 is used to raise and lower the stripper blade 18 in conventional fashion.

It should be understood by those skilled in the art that various modifications may be made in the present invention without departing from the spirit and scope thereof, as described in the specification and defined in the appended claims.

What is claimed is:

1. An apparatus for moistening the flap of an envelope, comprising:

a tank for holding a volume of water;

a moistening brush pivotably mounted on said tank, said tank having a vertical wall located beneath said brush;

an envelope feeding means, said feeding means adapted to transport an envelope whereby the flap of the envelope makes contact with said moistening brush;

a first roller rotatably journalled in said tank;

a second roller rotatably journalled in said tank and situated below said first roller;

an endless belt trained over said first and second rollers, said belt having one reach situated adjacent but spaced from said vertical wall by an amount which permits a meniscus to be formed between said reach and said wall, whereby water is conveyed from said tank to said brush; and an envelope flap sealing means.

2. The apparatus of claim 1, wherein said tank includes a stripper blade, and said moistening brush is secured to said stripper blade.

3. The apparatus of claim 2, additionally comprising means for adjusting the tension on said belt.

4. The apparatus of claim 3, wherein said first roller comprises a driver roller.

5. The apparatus of claim 4, additionally comprising means for changing the speed of the drive roller.

* * * * *